US006609313B2

(12) United States Patent
Orso

(10) Patent No.: US 6,609,313 B2
(45) Date of Patent: Aug. 26, 2003

(54) ALPINE SKI BOOT

(75) Inventor: Piero Orso, Cassola (IT)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 09/892,272

(22) Filed: Jun. 26, 2001

(65) Prior Publication Data

US 2002/0000052 A1 Jan. 3, 2002

(30) Foreign Application Priority Data

Jun. 30, 2000 (CH) ..... 1302/00

(51) Int. Cl.[7] ..... A43B 5/04

(52) U.S. Cl. ..... 36/117.3; 36/117.1; 36/81; 36/15

(58) Field of Search ..... 36/117.1, 117.3, 36/117.5, 81, 100, 101, 15

(56) References Cited

U.S. PATENT DOCUMENTS

| | | | | |
|---|---|---|---|---|
| 3,677,567 A | | 7/1972 | Salomon | |
| 4,062,134 A | * | 12/1977 | Ryder | 280/615 |
| 4,351,120 A | * | 9/1982 | Dalebout | 36/117.3 |
| 4,499,674 A | * | 2/1985 | Olivieri | 280/607 |
| 4,937,955 A | * | 7/1990 | Bonaventure | 280/613 |
| 4,945,659 A | * | 8/1990 | De Marchi et al. | 36/117.5 |
| 5,123,183 A | * | 6/1992 | Paris et al. | 36/117.3 |
| 5,214,865 A | | 6/1993 | Sartor | |
| 5,293,702 A | * | 3/1994 | Miyoshi et al. | 36/117.3 |
| 5,400,527 A | * | 3/1995 | Marega et al. | 36/117.3 |
| 5,918,386 A | * | 7/1999 | Marmonier | 36/115 |
| 6,065,228 A | | 5/2000 | Begey | |

FOREIGN PATENT DOCUMENTS

| | | |
|---|---|---|
| EP | 0908203 | 4/1999 |
| FR | 1587912 A | 4/1970 |
| FR | 2774266 A | 8/1999 |

* cited by examiner

*Primary Examiner*—M D Patterson
(74) *Attorney, Agent, or Firm*—Bugnion S.A.; John Moetteli

(57) ABSTRACT

An alpine ski boot has a curb intended to allow the boot to be held on a ski by either a front binding or a rear binding. The curb has a flange (4) which is nonremovably secured to the lower part of the boot and a removable curb piece (8; 16; 16') fixable either immediately underneath the flange, wherein the overall height of the boot measured from a lower surface of the curb piece to the top of the boot is maximized or immediately above the flange wherein the overall height of the boot from the lower surface of the boot adjacent the flange to the top of the boot is minimized.

10 Claims, 5 Drawing Sheets

Fig.4
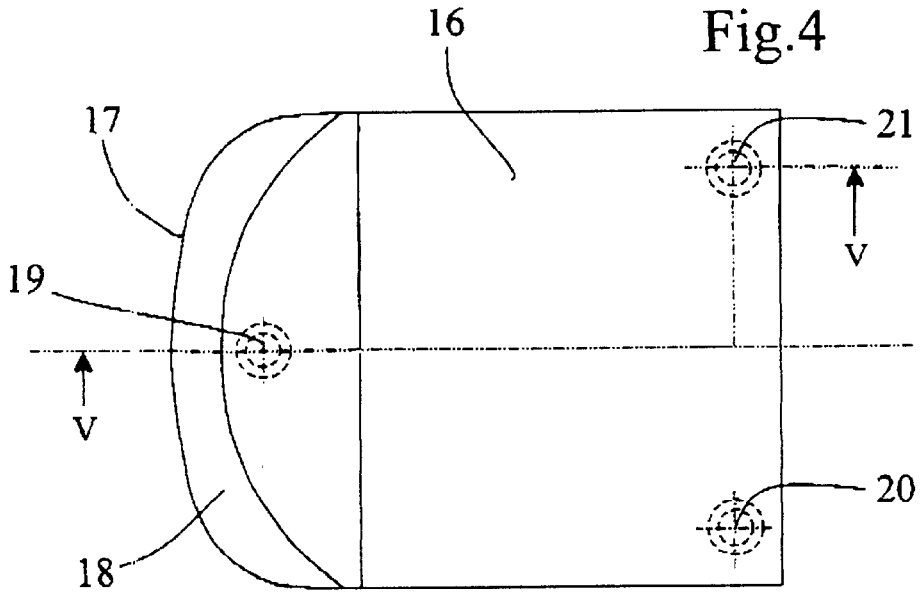
Fig.5
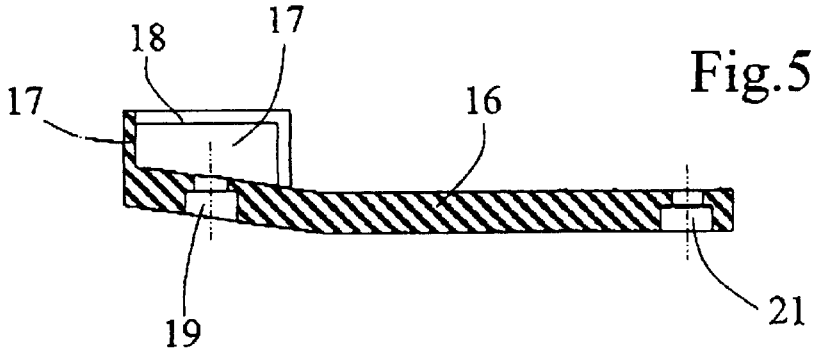
Fig.6
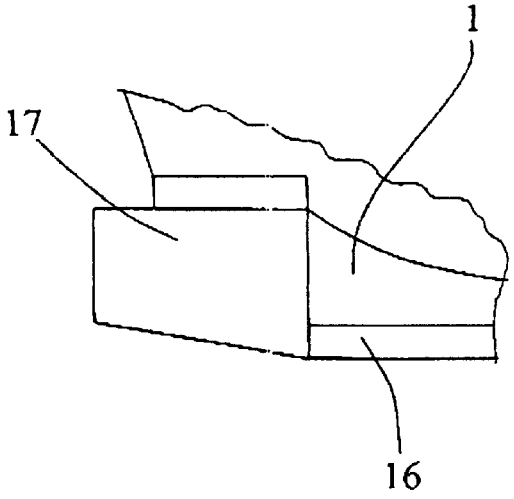
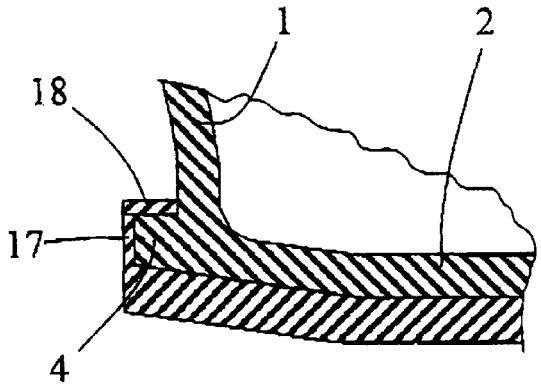
Fig.7

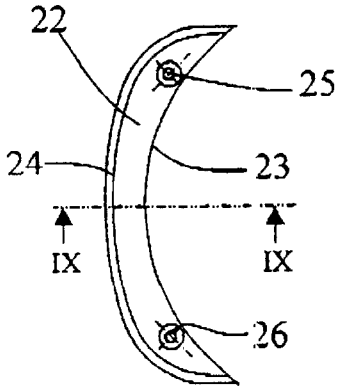
Fig.8
Fig.9
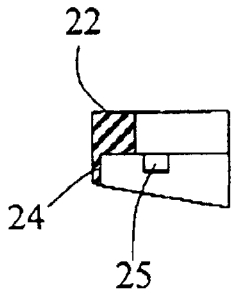
Fig.10
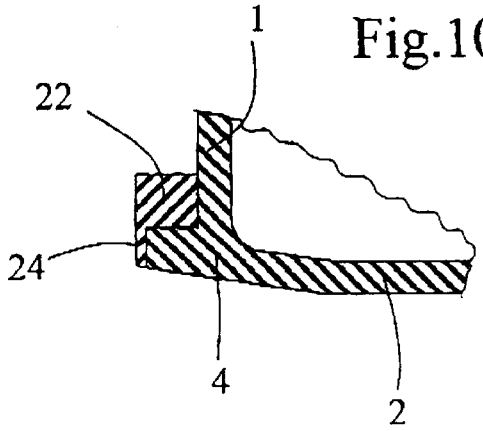
Fig.11
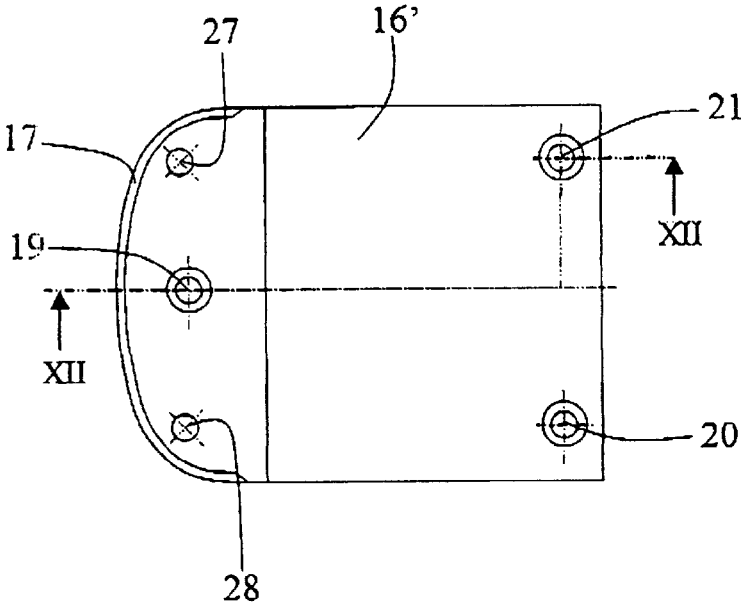
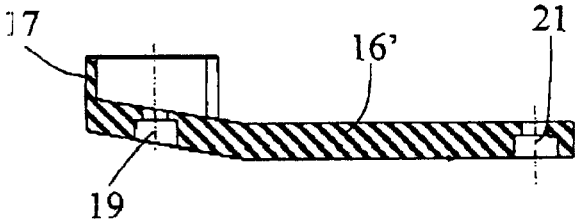
Fig.12

ALPINE SKI BOOT

FIELD OF THE INVENTION

The subject of the present invention is an alpine ski boot, the lower part of which comprises, at the front and/or at the rear, a kerb of standardized height intended to allow the boot to be held on a ski by a front binding and a rear binding.

Modern alpine ski boots are generally equipped, at the front and at the rear, with bearing plates which are attached and fixed to the lower part of the boot by means of screws, for example as described in U.S. Pat. No. 5,214,865, the content of which is incorporated by reference.

Modern skis, known by the name of "carving" skis, that is to say skis the sides of which are somewhat curved so that they widen from the middle forward and backward, allow turns of uniform curvature to be made with ease. When weight is transferred onto the edges, the legs are quite steeply inclined sideways, which means that the boots, held by conventional bindings fixed directly to the ski, tend to touch the snow and therefore to destabilize the skier. In order to alleviate this drawback, it is known practice for ski binding elements to be mounted on a raiser plate. Such a plate is described, for example, in patent application EP 0 908 203, the content of which is incorporated by reference. This raiser plate does, however, have the effect of increasing the weight of the ski and of impeding the natural work of the ski in bending and in torsion.

It is an object of the invention to allow the boot to be raised up off the ski without the use of a raiser plate.

It is another object of the invention to allow simply the heel to be raised so as to increase the forward lean of the boot and therefore of the leg.

The ski boot according to the invention is one wherein the kerbs consist, over part of their height, of a part nonremovably secured to the lower part of the boot and, over the remainder of the height, at the choice or the user, of a removable kerb piece that can be fixed under the part nonremovably secured to the lower part of the boot or of a removable kerb piece that can be fixed on the top of the part nonremovably secured to the lower part of the boot.

The lower part of the boot may, for example, be part of the shell or an attached sole.

PRIOR ART

U.S. Pat. No. 6,065,228, the content of which is incorporated by reference (EP 0 933 034) discloses a ski boot equipped with removable and interchangeable pads at the front and at the rear so as to allow the sole of the boot to be adapted to suit various standards of binding, for example alpine ski bindings, snow boarding bindings or cross-country skiing bindings. It is not possible to raise the boot used with a standardized alpine ski binding.

SUMMARY OF THE INVENTION

When the boot according to the invention is used with the kerb pieces fixed under the parts of the kerbs which are secured to the lower part of the boot, the boot is raised up off the ski by an amount equal to the thickness of the kerb pieces. The height of the kerbs complies with the maximum height allowed by the standards. If the boot is used with the kerb pieces fixed on the top of the parts of the kerbs secured to the lower part of the boot, then the boot is liken able to a conventional boot.

The boot can be modified without further ado by the user.

The material of the lower part of the boot is generally the same as that of the shell of the boot and this material is generally polyurethane. By contrast, the kerb pieces may be made of a different material, or even of a multi-material complex exhibiting, in certain regions, a better coefficient of slip, which has the effect of making the binding easier to release in the event of a fall, and, in other regions, characteristics of greater adhesion, avoiding falling when walking.

BRIEF DESCRIPTION OF THE DRAWINGS

The appended drawing depicts, by way of example, three embodiments of the invention.

FIG. 4 is a plan view of a second embodiment of the kerb piece intended to be fixed under the front part of the boot.

FIG. 5 is a view in section on V—V of FIG. 4.

FIG. 6 is a side view of the front part of the boot equipped with the kerb piece depicted in FIGS. 4 and 5.

FIG. 7 is a view in longitudinal vertical section of the portion depicted in FIG. 6.

FIG. 8 is a plan view, from underneath, of second embodiment of the piece intended to be fixed to the nonremovable front part of the lower part of the boot.

FIG. 9 is a view in section on IX—IX of FIG. 8.

FIG. 10 is a view in longitudinal section of the front of the boot equipped with the kerb piece depicted in FIGS. 8 and 9.

FIG. 11 is a plan view of a third embodiment of the kerb piece intended to he fixed under the front part of the boot.

FIG. 12 is a view in section on XII—XII of FIG. 11.

DESCRIPTION OF THE PREFERRED EMBODIMENTS

Figure 1:
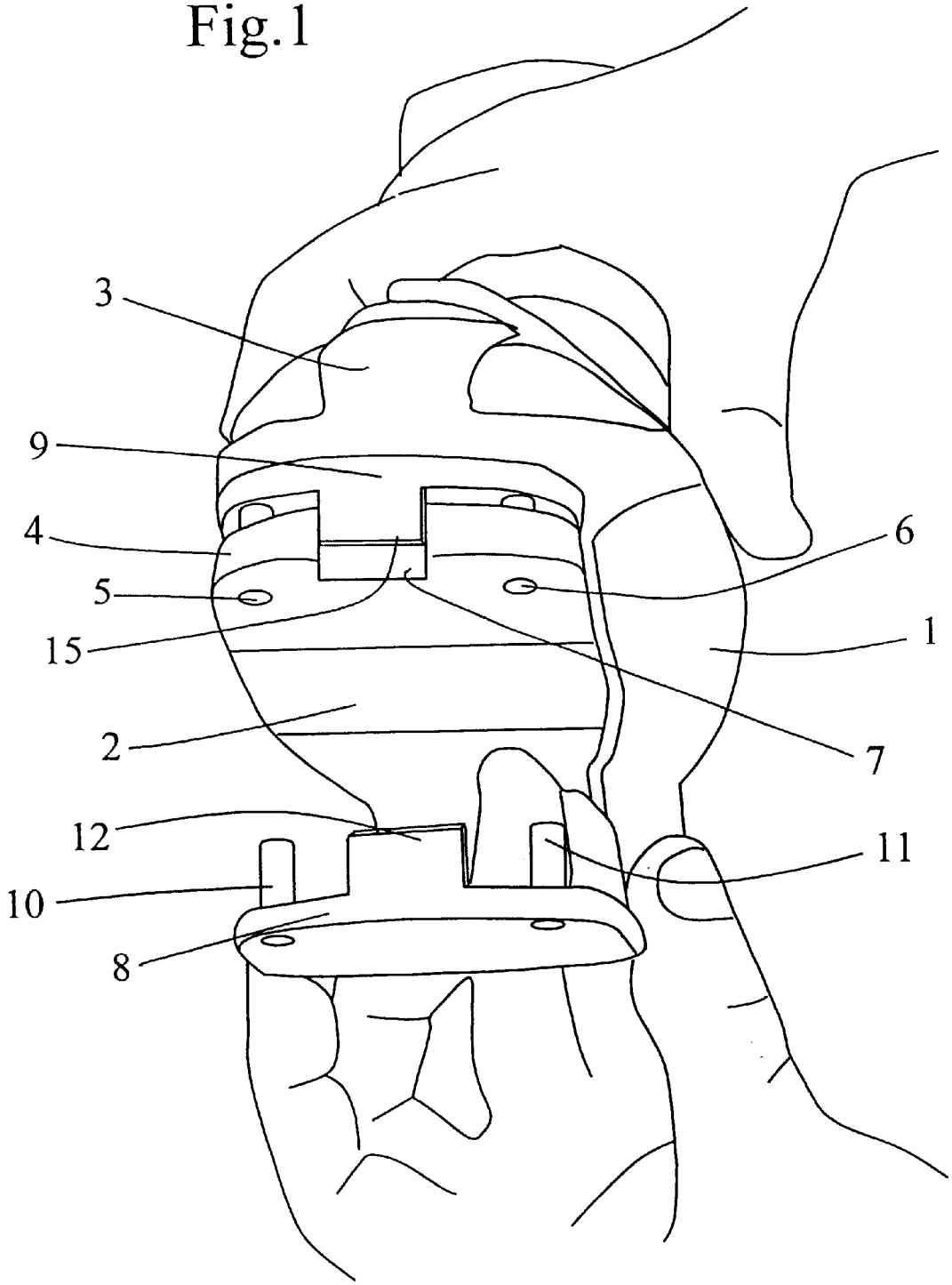
FIG. 1 depicts the fitting of an kerb piece on the kerb on the front part of a boot according to a first embodiment.

FIG. 1 shows a boot shell 1 equipped with a lower part 2. In this particular instance, the shell is made of two materials of different rigidities, the lower part 2 being formed as one piece with the more rigid material 3.

Figure 2:
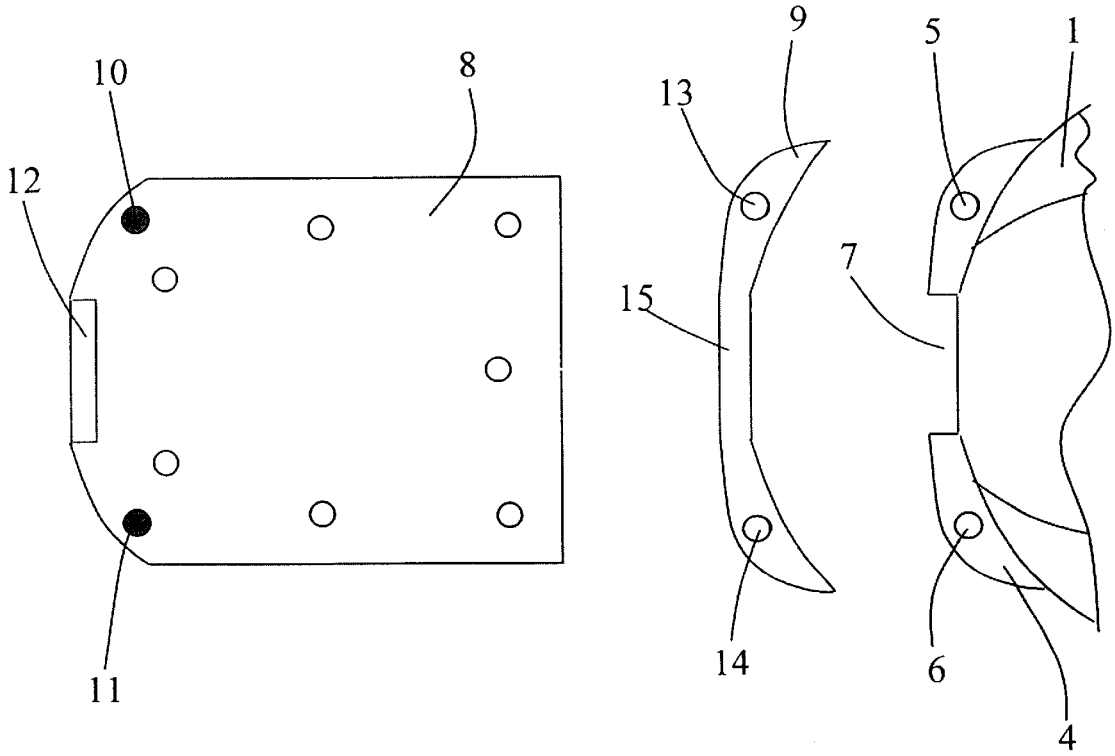
FIG. 2 depicts separately, in plan, the part of the front kerb secured to the lower part of the boot and the two pieces which can be attached to this front part.
Figure 3:
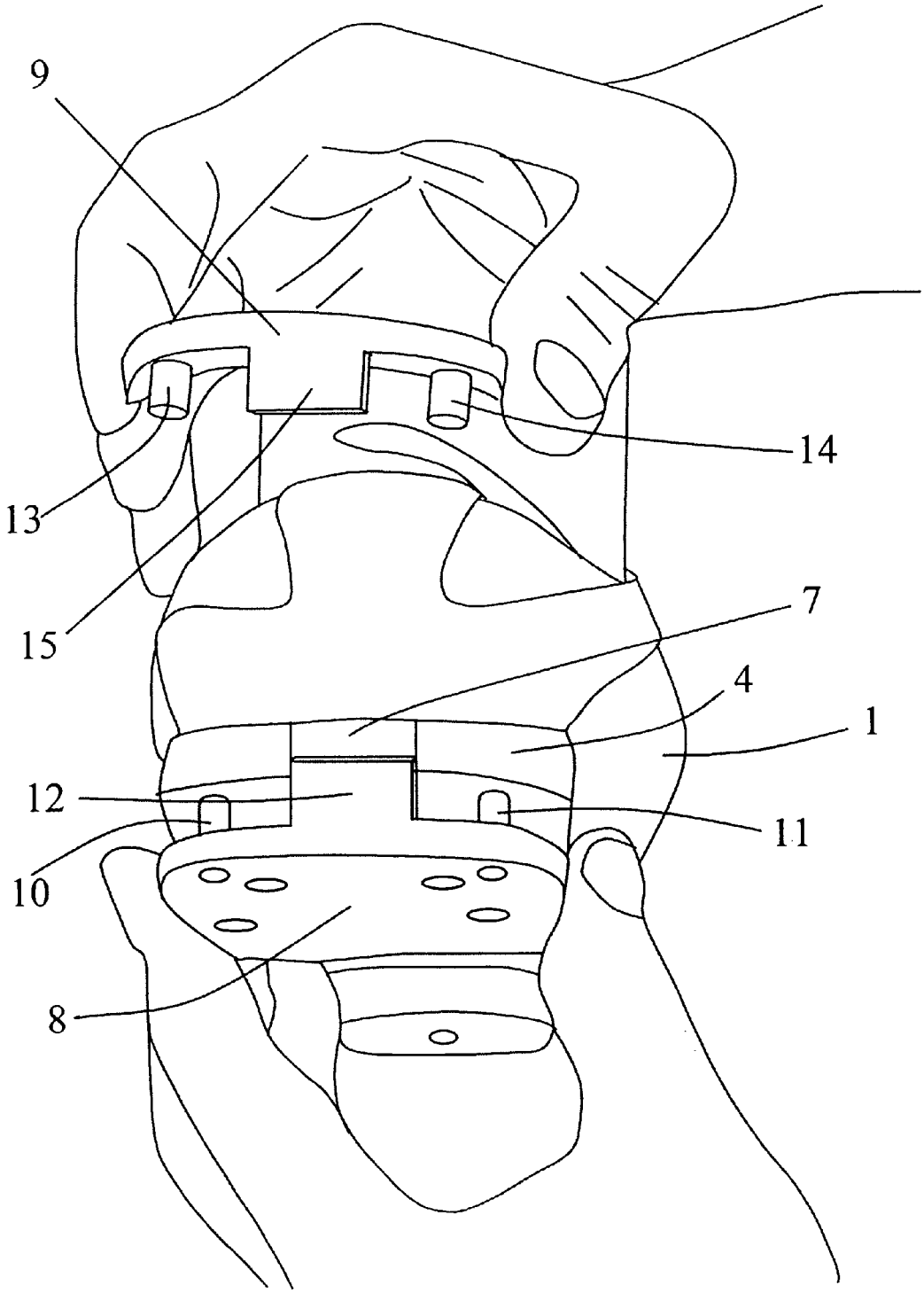
FIG. 3 depicts the fitting of the kerb piece under the kerb of the front part of the boot.

The lower part 2 has a flange 4 projecting forward, which can be seen in particular in FIG. 2. This flange 4 defines the contour of the front kerb of the boot and its height corresponds to part of the height of a normalized kerb. Two round holes 5 and 6 pass vertically through the flange 4 and it has a central frontal cutout 7 of approximately rectangular shape. One of the pieces 8 or 9 can be fixed, according to choice, to the flange 4. The piece 8 is in the form of an approximately rectangular plate with a contour tailored to the contour of the lower part of the boot and of the flange 4. It is equipped with two pegs 10 and 11 perpendicular to the piece 8 and slightly conically tapered and, on its anterior edge, with a rectangular positioning peg 12 directed in the same direction as the pegs 10 and 11 and of a shape that mates with the shape of the frontal housing formed by the cutout 7 of the flange 4 of the lower part of the boot. As can be seen in FIGS. 1 and 3, the piece 8 can be fixed under the lower part of the boot by introducing the pegs 10 and 11 into the holes 5 and 6 and by introducing the positioning peg 12 into the cutout 7. The front kerb in this case consists of the flange 4 and of the piece 8 and the boot is raised.

The piece 9 has a contour that matches the contour of the projecting flange 4. It is also equipped with two pegs 13 and 14 identical to the pegs 10 and 11 and with a positioning peg 15 identical to the peg 12. The piece 9 can be fitted onto and fixed to the flange 4 of the lower part of the boot to constitute the front kerb, as depicted in FIG. 1.

The rear kerb of the boot is produced in the same way as the front kerb and can be raised by itself in order to cause the boot to lean further forward.

The method of positioning using pegs and holes could be replaced by any other appropriate positioning means.

FIGS. 4 and 5 depict a second embodiment of the piece intended to be fixed on the front part of the boot, that is to say a piece corresponding to the piece 8 of FIGS. 1 to 3. This piece 16 has an overall shape and a contour which are identical to those of the piece 8. It differs from the latter in that it has a frontal wall 17 standing up vertically at its anterior end. This wall 17 follows the contour of the piece 16 and extends on its rounded corners slightly beyond the points where the circular arcs meet the parallel sides of the piece 16. A horizontal wall 18 also extends, backward, from the upper end of the wall 17. As can be seen in FIGS. 6 and 7, the walls 17 and 18 cap the nonremnovable flange 4 of the front kerb. The wall 17 presses against the frontal wall of the flange 4 while the wall 18 sits on the horizontal upper face of the flange 4.

The piece 16 has a frontal face without discontinuity and the height of which is at least equal to 9 mm. Such a face is particularly suitable for collaborating with the elements of a ski binding pressing against this frontal face. The walls 17 and 18 form a housing into which the flange 4 secured to the lower part of the boot sits so that the piece 16 is securely held on the flange 4. Furthermore, as a material that has a coefficient of friction lower than that of the material of which the flange 4 is made will preferably be used for the piece 16, the jaw of a ski binding will advantageously rest on the wall 18 rather than on the flange 4. As depicted in FIG. 7, the flange 4 may therefore consist of a simple projection of the shell 1 of the boot. The piece 16 is also equipped with three holes 19, 20, 21 for the passage of screws for securing to the boot.

The piece intended to be fixed to the front kerb, that is to say the piece corresponding to the piece 9 in the first embodiment, is depicted in FIGS. 8 and 9. This piece 22, viewed in plan, has a concave curvature 23 intended to follow the shape of the frontal end of the shell 1 above the lower part of the boot. The opposite side lo the side 23 has a shape identical to that of the piece 16. Along this side, the piece 22 has a wall 24 perpendicular to the plane of the piece 22, this wall 24 being identical in shape and extent in the horizontal plane to the wall 17 of the piece 16. Like the wall 17, the wall 24 has a thickness of about 1.5 mm. The piece 22 also has two positioning pegs 25 and 26 for positioning it on the flange 4. The piece 22 mounted on the boot is depicted in section in FIG. 10. In the example depicted, the piece 22 with its wall 24 forms a frontal face, the minimum height of which is 14 mm. The lower edge of the wall 24 adjoining the lower edge of the flange 4 and, respectively, the lower part of the boot 2, the height of the vertical outer face of the piece 22 increases in the direction toward the rear of the boot. Once again, the piece 22 has a continuous vertical outer surface capable of collaborating in the optimum way with parts of a ski binding pressing against this face.

The third embodiment depicted in FIGS. 11 and 12 is in fact a simplified variation of the piece 16 depicted in FIGS. 4 to 7. This variation 16' differs from the second embodiment through the absence of the horizontal wall 18 and through the presence of two positioning pegs 27 and 28. In all other respects, the piece 16' is identical to the piece 16.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. An alpine ski boot having a top, a lower part having a forward and rearward portion and an overall height, the lower part of the boot of which comprises at least one kerb intended to allow the boot to be held on a ski by either a front binding or a rear binding, wherein the kerb comprises a flange nonremovably secured to at least one of the forward or rearward portions of the lower part, the at least one flange capable of alternatively receiving at least two removable kerb pieces wherein at least one of said kerb pieces is adaptable to be fixed to the underneath of the at least one flange, such that the overall height of the boot measured from a lower surface of the kerb piece to the top of the boot is maximized and wherein at least one other of said kerb pieces is adaptable to be fixed immediately above the same at least one flange such that the overall height of the boot from the lower surface of the boot adjacent the at least one flange to the top of the boot is minimized.

2. The ski boot as claimed in claim 1, wherein the kerb pieces (8; 16; 16') are made of a material with a lower coefficient of friction than that of which the flange is made.

3. The ski boot as claimed in claim 1, wherein the part (4) of the kerbs that is nonremovably connected to the boot has, on their upper and lower faces, positioning means (5, 6) and wherein the kerb pieces have complementary positioning means (10, 11, 13, 14; 27, 28).

4. The ski boot as claimed in claim 3, wherein the positioning means comprise holes (5, 6) and pegs (10, 11, 13, 14; 27, 28).

5. The ski boot as claimed in claim 4, wherein the pegs are frustaconical.

6. The ski boot as claimed in claim 4 or 5, wherein the kerb pieces (8, 9) have positioning pegs (12, 15) that fit into a corresponding flange.

7. The ski boot as claimed in one of claims 1 to 5, wherein the removable kerb pieces (16, 22; 16') fixable to the front of the boot have a frontal part (17, 24) which is positioned in front of the flange (4).

8. The ski boot as claimed in claim 7, wherein said frontal part comprises a wall (17) extending continuously over the entire frontal part of the front kerb, which frontal part is intended to bear against part of a ski binding.

9. The ski boot as claimed in claim 7, wherein the removable kerb piece (16) fixable to the front of the boot and under the boot also has a horizontal wall (18) which at least partially covers an upper face of the flange (4).

10. The ski boot as claimed in claim 2, wherein the flange (4) has, on its upper and lower face, positioning means (5, 6) and wherein the kerb piece has complementary positioning means (10, 11, 13, 14; 27, 28) which position the kerb piece on the flange.

* * * * *